US006086157A

United States Patent [19]

Toso

[11] Patent Number: 6,086,157

[45] Date of Patent: Jul. 11, 2000

[54] ERGONOMIC CHAIR

[76] Inventor: Victor Toso, 2438 Como Ave., SE., St. Paul, Minn. 55108

[21] Appl. No.: 07/868,415

[22] Filed: Apr. 15, 1992

Related U.S. Application Data

[63] Continuation-in-part of application No. 07/639,339, Jan. 10, 1991, abandoned.

[51] Int. Cl.[7] ..... A47C 7/50

[52] U.S. Cl. ..... 297/423.11; 297/423.19; 297/383; 297/464

[58] Field of Search ..... 297/429–431, 297/433, 435, 464, 466, 488, 348, 383, DIG. 4, DIG. 10, 423, 427, 250, 252, 423.11, 423.12, 423.19, 423.2, 423.22, 423.23, 340, 250.1

[56] References Cited

U.S. PATENT DOCUMENTS

| | | | |
|---|---|---|---|
| 485,277 | 11/1892 | Hunter | 297/466 |
| 1,065,022 | 6/1913 | Bell | 297/427 |
| 2,722,974 | 11/1955 | Stagner | 297/427 |
| 3,215,469 | 11/1965 | Wamsley | 297/427 |
| 4,065,180 | 12/1977 | Karay | 297/466 |
| 4,247,064 | 1/1981 | Schulman et al. | 297/466 X |
| 4,762,364 | 8/1988 | Young | 297/250 |
| 4,763,952 | 8/1988 | Gaudreau, Jr. | 297/383 |
| 4,948,156 | 8/1990 | Fortner | 297/DIG. 10 X |
| 5,054,852 | 10/1991 | Tholkes | 297/423 X |

FOREIGN PATENT DOCUMENTS

| | | | |
|---|---|---|---|
| 0454926 | 3/1949 | Canada | 297/252 |
| 3903388 | 8/1990 | Germany | 297/423 |

*Primary Examiner*—Milton Nelson, Jr.
*Attorney, Agent, or Firm*—Crompton, Seager & Tufte, LLC

[57] ABSTRACT

An ergonomic support for maintaining a user in an erect sitting posture, including a seat, a knee brace and a backrest, the position of which are adjustable relative to one another. Also set forth is a self-contained ergonomic chair which includes a frame to be supported on a floor, a seat supported to the frame, a backrest supported to the frame to the rear of the seat, a knee brace supported with respect to the frame to be positioned forward of the seat, and a manual adjustment mechanism operable by a person seated in the chair to adjust the forward and rearward spatial relationships of the seat, the backrest and the knee brace with respect to each other.

14 Claims, 3 Drawing Sheets

ERGONOMIC CHAIR

This is a Continuation-in-Part of Ser. No. 07/639,339, filed Jan. 10, 1991, now abandoned.

BACKGROUND OF THE INVENTION

The invention relates to chairs or supports, and more specifically to chairs in which the user's back and knees are supported with respect to the chair seat to enhance the anatomical, physiological and psychological support afforded to the user by the chair.

It is well known to strap persons into wheelchairs so that they do not fall out accidentally and/or cannot "escape" from the wheelchair to possibly do damage to themselves because of impaired physical abilities or otherwise. Such restraints can be in the form of belts encircling the waist, belts or other bindings encircling the upper portions of the torso, or belts or other restraints encircling the legs below the knee, etc.

Structures have been developed to allow a person confined in a wheelchair to be raised from a sitting to a standing position and to be lowered from a standing position to a sitting position. See U.S. Pat. No. 4,569,556 granted to Pillot on Feb. 11, 1986 and U.S. Pat. No. 4,623,194, also granted to Pillot but on Nov. 18, 1986.

A back supporting device which permits a wearer to sit in an upright position for extended periods of time without discomfort has been developed. Such a device can be useful when the user is in a sitting position. See U.S. Pat. No. 4,773,106 granted to Toso et al. on Sep. 27, 1988, incorporated herein by this reference to it.

The back support of the Toso patent is not conveniently usable by office workers, bench workers or others who could well profit from the support of the back resulting from the fixed positioning of the knees with respect to a back support, but who have to rise from this supported position and return to it numerous times during the overall period that they are primarily seated.

The Pillot patents, and the usual or preferred wheelchair restraints are not believed to be pertinent to the present invention.

SUMMARY OF THE INVENTION

The ergonomic support of the present invention was developed so as to maintain a seated person in an erect sitting posture in order to aid in relieving the stress in the back while seated and thus prevent back problems. The ergonomic support of the present invention includes a seat, a knee brace means and means to connect the seat to the knee brace means so that the position of the knee brace means is adjustable relative to the seat and a backrest when the support is secured to a chair having a backrest. The device could also be made so as to include a backrest.

In another embodiment, an ergonomic chair for use on a floor includes a frame supported on the floor, a seat supported with respect to the frame above the floor, backrest means supported with respect to the frame to the rear of the seat, knee brace means supported with respect to the frame forward of the seat and adjustment means to adjust the mutual forward and rearward horizontal spatial relationships of the seat, the backrest means and the knee brace means with respect to one another.

Other objects and advantages of the present invention will become apparent from the following detailed description when viewed in conjunction with the accompanying drawings, which set forth certain embodiments of the invention.

DESCRIPTION OF THE INVENTION

Figure 1:
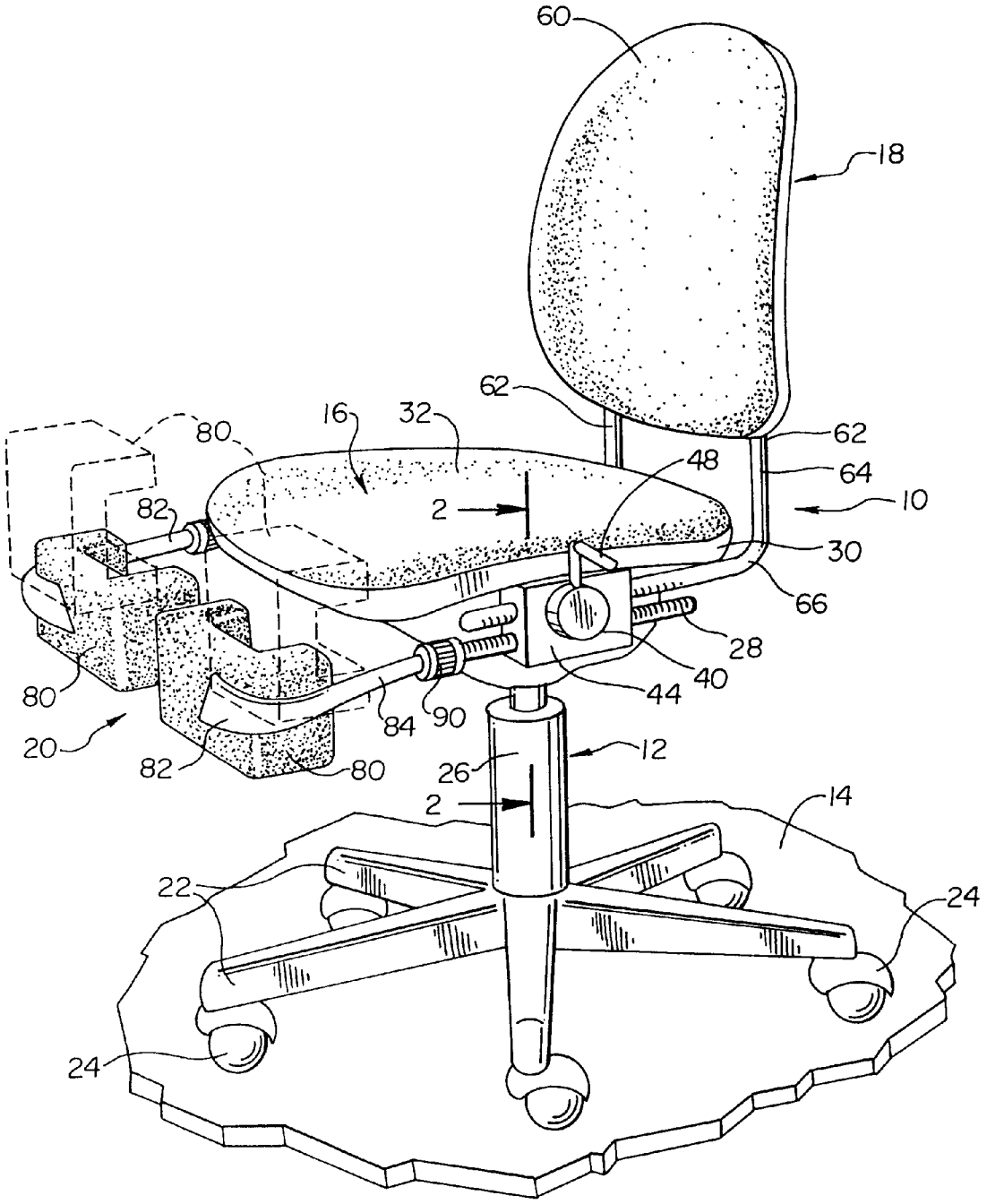
FIG. 1 is a perspective view of one form of ergonomic chair of the present invention.
Figure 2:
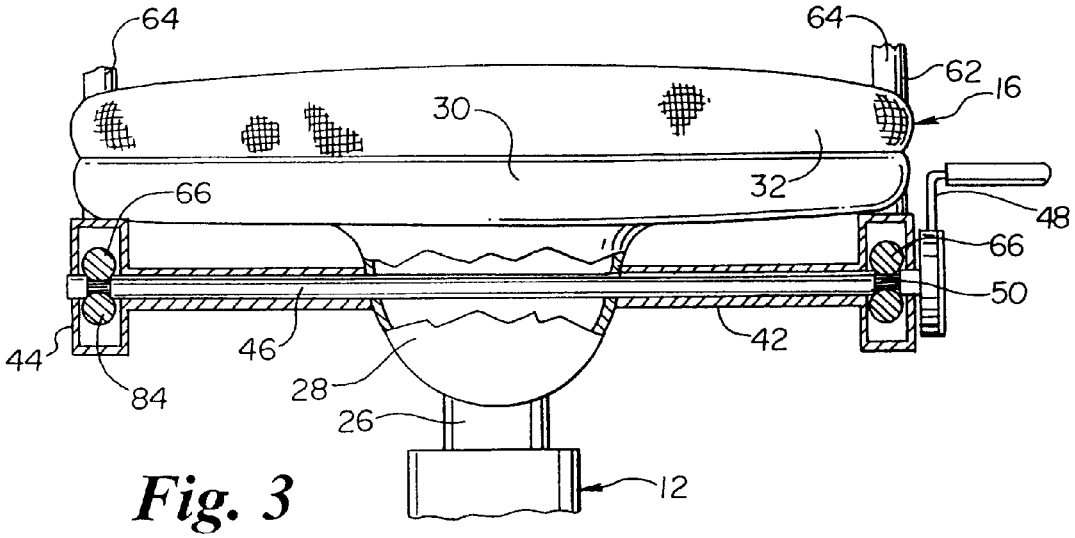
FIG. 2 is an enlarged fragmentary front elevational view partially sectional along a vertical plane defined by line 2—2 in FIG. 1.
Figure 3:
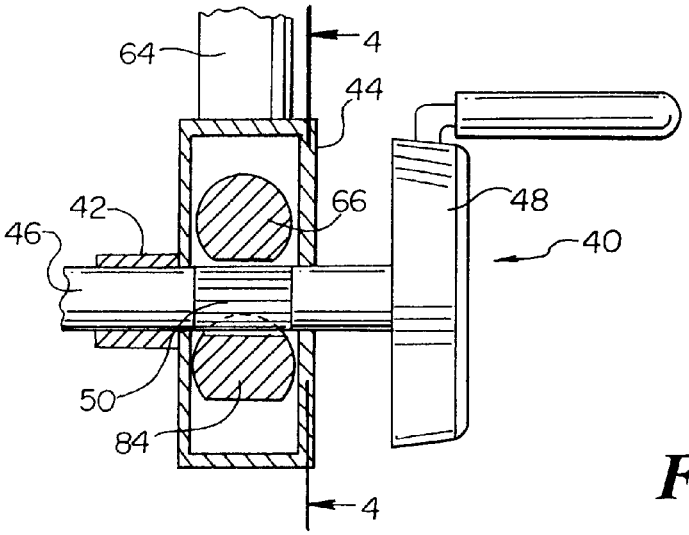
FIG. 3 is a further enlarged vertical sectional view also along line 2—2 in FIG. 1.
Figure 4:
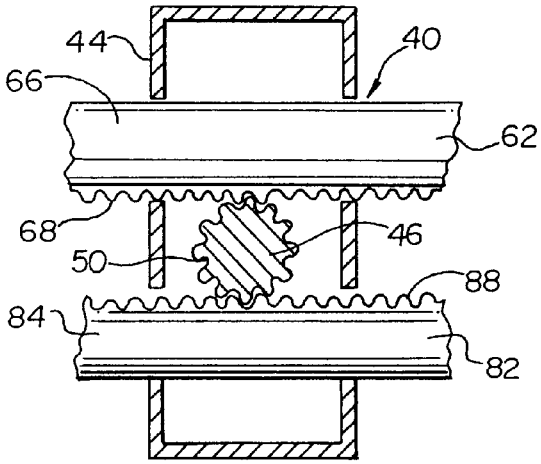
FIG. 4 is a vertical sectional view taken on line 4—4 in FIG. 3.

The detailed embodiments of the present invention are disclosed herein, however, it is to be understood that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Funk & Wagnall's Standard Dictionary has defined ergonomics as the study of the relationship between man and his working environment, with special reference to anatomical, physiological and psychological factors. In every sense of that definition, the chair 10 is an ergonomic chair. That chair includes a frame 12 supported on a floor 14, a seat 16 supported on the frame 12, backrest means 18 supported with respect to the frame 12 and knee brace means 20 also supported with respect to the frame 12.

As shown, the frame 12 includes a plurality of legs 22 with associated casters 24 supporting the chair on the floor 14. The frame also includes an upstanding chair seat support column 26 at the upper end of which is a chair seat support fitting 28 to which the chair seat 16 is fixedly attached in any usual or preferred manner.

Seat 16, as shown, includes a solid seat base 30 and a seat cushion 32.

An adjustment means 40 is provided to adjust the forward and rearward horizontal spatial relationships of the seat, the backrest means and the knee brace means with respect to each other. The adjustment means includes concentrically aligned gear box support sleeves 42,42 extending integrally outwardly from opposite sides of the support fitting 28, gear boxes 44,44 integrally supported on opposite ends of the sleeves 42,42, and an ergonomic chair positioning shaft 46 extending through the sleeves 42,42 and through provided openings in the chair seat support fitting 28 and each of the gear boxes 44,44. A positioning shaft control handle 48 is integrally connected to the shaft 46 and is positioned outwardly of the seat 16.

As part of a rack and pinion drive, portions of the positioning shaft 46 within the gear boxes 44,44 are constituted as drive pinions 50,50.

Backrest means 18 includes a backrest 60 and a pair of L-shaped backrest support arms 62,62 having upwardly extending portions 64 attached to the backrest 60 in any usual or preferred manner, and having forwardly extending portions 66, each extending through provided openings in one of the gear boxes 44. The lower edge of each forwardly extending portion 66 is provided with rack teeth 68 in meshing relationship with one of the drive pinions 50 of positioning shaft 46 within one of the gear boxes 44.

The knee brace means 20 includes knee pads 80,80, each integrally connected to one of a pair of knee pad support arms 82, 82. Each of these support arms 82 includes a rearwardly extending portion 84 which passes through provided openings in one of the gear boxes 44. Upper edges of each of these rearwardly extending portions 84 of the knee pad support arms are provided with rack teeth 88 positioned in meshing relationship with one of the drive pinions 50 of positioning shaft 46. At an intermediate position of the rearwardly extending portion 84 of each of the support arms 82, forwardly of the rack teeth 88, a swivel means 90 is provided so that the knee pads 80 can be moved between an operating condition as seen in dotted lines in that figure. It is the upright position that these knee pads will have when a person first sits on a chair or finally gets up from the chair. The swivel means can be of any usual or preferred construction and can be operable between the full line position as seen in FIG. 1 and 180° outwardly from that position to give maximum clearance to the person sitting down and/or getting up from the chair.

With the knee pads 80 positioned as seen in dotted lines in FIG. 1, a person will take position on the seat 16. The control handle 48 will be turned in a clockwise direction as seen in FIG. 1 if necessary so that the knee pads 80 will be positioned ahead of the person's knees. The knee pads will then be rotated into position as seen in full lines in FIG. 1, and the control handle will be turned in a counterclockwise direction as seen in that figure, and the position of the person on the seat will be adjusted until at least the lumbar regions of the back are firmly but comfortably supported by the backrest 60 and the knees are firmly but comfortably supported against the knee pads 80,80 so as to maintain that position of the person's back against the backrest 60.

When so positioned, the body of the person in the chair will not have the tendency to slide forward or backward, and so the most comfortable, healthful position can be maintained indefinitely.

To leave the chair, the sitting person need only rotate the control handle 48 in a clockwise direction as seen in FIG. 1 to move the knee pads 80 into a clearing relationship forward of the knees, rotate the knee pads to the position seen in dotted lines in FIG. 1 and rise from the chair.

While the seat 16 is shown to be fixedly mounted with respect to the chair seat support fitting 28 and the upstanding chair seat support column 26 of the frame 12, it may also be supported so as to move horizontally. Therefore, it is to be noted that the adjustment means 40 may be configured to change the relationship of the knee brace means 20 and the seat 16 with respect to the backrest means 18, change the relationship of the seat 16 and the backrest means 18 with respect to the knee brace means 20, and/or change the relationship of the knee brace means and backrest means with respect to the seat. In all cases, the frame serves to support all three of these elements. Thus, any one of the seat, backrest means and knee brace means could be fixed with respect to the frame 12, or all three could be mounted so as to be adjustable horizontally with respect to the frame in accordance with the concept of this invention and the claims which follow.

Figure 5:
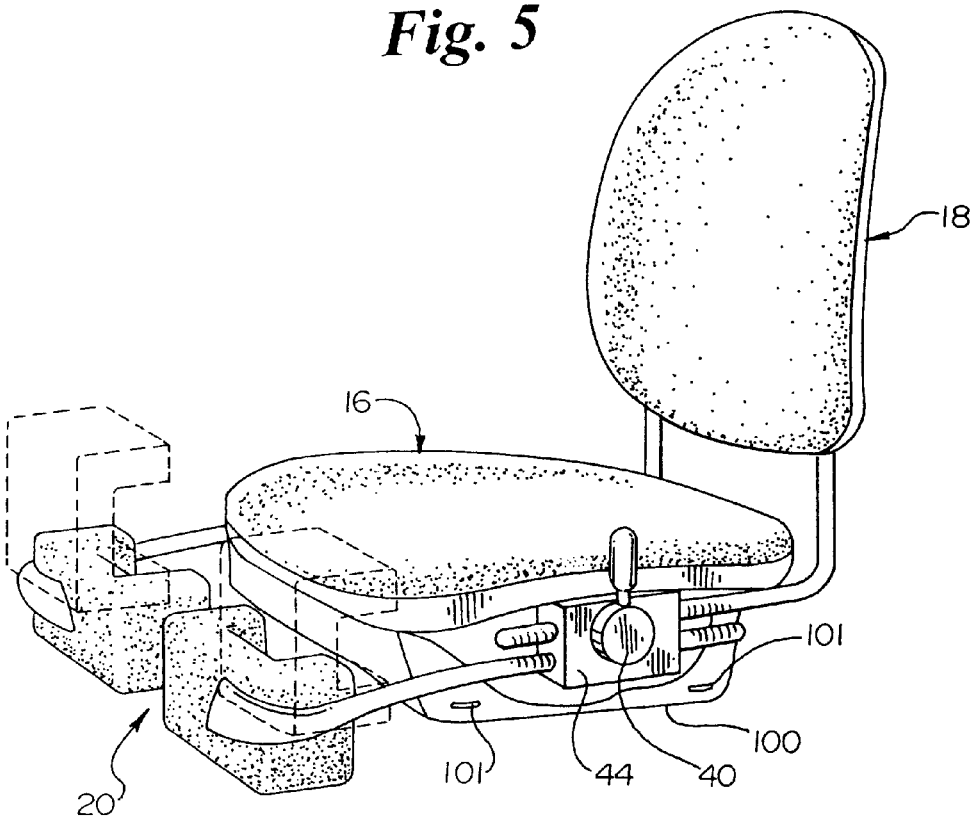
FIG. 5 is a perspective view of a second embodiment of the present invention; and, FIG. 6 is a perspective view of still another embodiment of the present invention.
Figure 6:
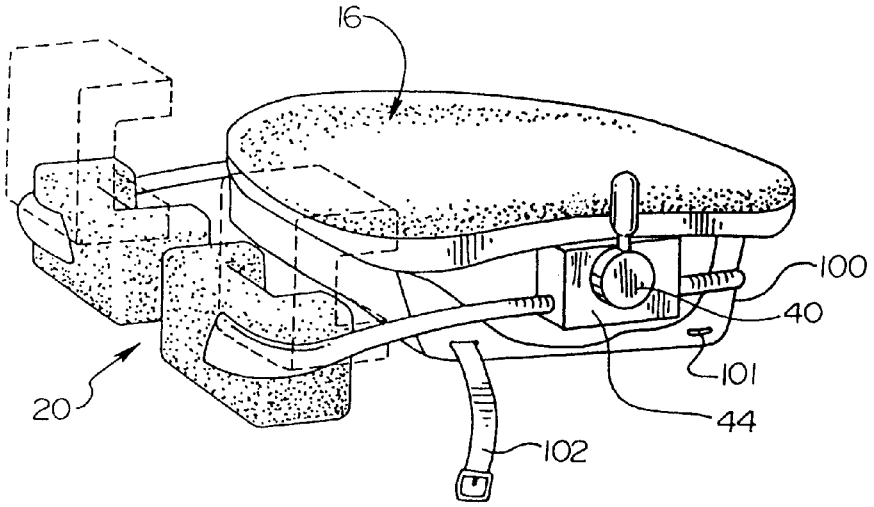

With reference to FIGS. 5 and 6, other embodiments of the present invention are shown. In these embodiments, the ergonomic support does not include a frame for supporting the seat above the ground. These ergonomic supports are intended to be used with any known chair or stool. As shown, the seat 16 includes a bottom enclosure 100 instead of an upright support frame 12. In the preferred embodiment, the enclosure is equipped with slots 101 which can cooperate with straps 102 for securing the ergonomic support to a chair or stool. There are numerous other suitable attachment means for securing the ergonomic support to a chair and slots 101 and straps 102 are just one such example.

The embodiment of FIG. 6 does not include a backrest and thus when in operation needs to be secured to a chair having a backrest. When in use, the knee brace means forces the lower torso of the user seated on the seat 16 into contact with the backrest such that the user is forced into an erect sitting position.

While various preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. An ergonomic support for maintaining a user in an erect sitting posture, said support comprising:

a seat lying in a first horizontal plane having a front edge;

knee brace means located on the front edge side of said seat at a level to intercept the knees of a user seated on said seat; and, means for connecting said knee brace means to said seat, including an incremental adjustment means for selectively adjusting the position of said knee brace means relative to the front edge of said seat in said first horizontal plane, a backrest connected to said seat so as to lie in a plane generally perpendicular to said first horizontal plane, whereby adjustment of said knee brace means forces the lower torso of the user seated on the seat into contact with the backrest when the adjustment means is operated to move the knee brace means towards said backrest, such that the user is forced into an erect sitting posture.

2. The invention of claim 1 wherein said seat includes a bottom enclosure having means for attachment to a chair.

3. The invention of claim 1 wherein said adjustment means includes a gear box attached to a portion of said seat, and said gear box includes a drive pinion coupled to a shaft having teeth which mate with said pinion.

4. The invention of claim 3 wherein said knee brace means is connected to said shaft.

5. An ergonomic support for maintaining a user in an erect sitting posture, said support comprising:

a seat lying in a first horizontal plane;

knee brace means located on one side of said seat at a level to intercept the knees of a user seated on said seat;

a backrest generally perpendicular to said seat and located on a second side of said seat opposite said knee brace means to intercept the back of a user seated on said seat; and, means for adjustably connecting said knee brace means to said backrest including an adjustment means for selectively adjusting the distance between said knee brace means and said backrest when said adjustment means is operated to cause both said knee brace means and backrest to move while said seat is maintained in said first horizontal plane.

6. The invention of claim 5 wherein said knee brace means and said backrest are coupled to move relative to one another by a pinion contained within a gear box mounted to said seat.

7. The invention of claim 5 wherein said seat includes a bottom enclosure having means for attachment to a chair.

8. The invention of claim 5, wherein said connection means includes a rotating member disposed between said knee brace means and said backrest.

9. The invention of claim 5 wherein said adjustment means includes a gear box attached to a portion of said seat and said gear box includes a drive pinion coupled to a shaft having teeth which mate with said pinion.

10. The invention of claim 9 wherein said knee brace means is connected to said shaft.

11. An ergonomic chair for use on a floor, said chair including:

a frame supported on the floor including an upstanding support means;

a seat having a front and rear supported with respect to the frame at a predetermined distance above the floor and perpendicular to said upstanding support means;

a backrest supported with respect to the frame to the rear of the seat in a position to intercept the back of a person seated on the chair;

knee brace means supported with respect to the frame in front of the seat at a level to intercept the knees of a person when seated on the chair; and means for connecting said backrest to said knee brace means including an adjustment means for selectively moving both the backrest and the knee brace means in order to adjust the distance along a horizontal axis between said backrest and the knee brace means in order to force the lower torso of the person seated on the chair into an erect sitting posture, while maintaining said seat perpendicular to said upstanding support means.

12. The ergonomic chair of claim 11 wherein said adjustment means includes a gear box attached to the frame for supporting said knee brace means, and said gear box includes a pinion for connecting said knee brace means to said backrest.

13. The ergonomic chair of claim 11 wherein said adjustment means includes a gear box attached to the frame for supporting said backrest, and said gear box includes a pinion for connecting said backrest to said knee brace means.

14. The ergonomic chair of claim 11 wherein said adjustment means includes a gear box attached to the frame for supporting said knee brace means and said backrest, and said gear box includes a rotating member for connecting said knee brace means to said backrest.

* * * * *